United States Patent [19]

Pelavin

[11] 4,378,866

[45] Apr. 5, 1983

[54] COMPARTMENTED SPORT BAG

[75] Inventor: Joseph Y. Pelavin, North Bergen, N.J.

[73] Assignee: CPG Products Corp., Minneapolis, Minn.

[21] Appl. No.: 241,341

[22] Filed: Mar. 6, 1981

[51] Int. Cl.[3] ..... B65D 30/22; A45C 3/00; A45C 13/26

[52] U.S. Cl. ..... 190/52; 190/41 R; 150/52 G; 206/315 R

[58] Field of Search ..... 190/41 R, 41 Z, 48, 190/51, 52; 150/30, 28 R, 52 G, 12; 206/315 R

[56] References Cited

U.S. PATENT DOCUMENTS

| | | | |
|---|---|---|---|
| 676,659 | 6/1901 | Mogg | 150/12 X |
| 1,999,064 | 4/1935 | Marks | 190/48 X |
| 2,533,850 | 12/1950 | Syracuse | 190/52 X |
| 2,609,897 | 9/1952 | Meyer | 190/52 X |
| 2,801,666 | 8/1967 | Steele | 190/51 X |
| 3,202,191 | 8/1965 | Kaplan | 150/30 |
| 3,587,795 | 6/1971 | Berry | 190/52 X |
| 3,696,850 | 10/1972 | Rosenblum | 190/52 X |
| 3,963,102 | 6/1976 | Carp | 190/41 Z X |
| 3,963,103 | 6/1976 | Cowen | 190/52 |
| 4,180,114 | 12/1979 | Katz | 150/28 R |

FOREIGN PATENT DOCUMENTS

| | | | |
|---|---|---|---|
| 1549246 | 11/1968 | France | 190/51 |

*Primary Examiner*—William Price
*Assistant Examiner*—Sue A. Weaver
*Attorney, Agent, or Firm*—G. O. Enockson; L. MeRoy Lillehaugen

[57] ABSTRACT

A multi-compartmented carrying case or sport bag for carrying clothing and equipment for playing sports. The sport bag is provided with a racquet compartment which is positioned exteriorly of the bag. A hanging compartment, or first clothing compartment, is suspended within the sport bag for carrying shorts, T-shirts, or the like. A second clothing compartment is formed below this hanging compartment, and it is especially adapted to carry shoes. A moisture-proof compartment is positioned within the hanging compartment for holding wet clothing such as a swim suit or wet towel. Separate zippered openings are provided for introducing articles into each compartment.

10 Claims, 9 Drawing Figures

COMPARTMENTED SPORT BAG

BACKGROUND OF THE INVENTION

The present invention relates to compartmented carrying cases for transporting sports equipment and associated wearing apparel, and more specifically to a carrying case or sport bag having a plurality of separate compartments for transporting clothing and equipment for sports activities, including racquet sports such as tennis, racquet ball, squash, badminton, and the like.

A variety of carrying cases, luggage bags and the like, are generally known for transporting clothing and/or equipment used while playing sports. Quite often, the case or bag merely provides a main compartment for holding a racquet, and a smaller compartment for holding balls to be used with the racquet, but no compartment for shoes and/or other wearing apparel. Thus, a separate bag is required for the wearing apparel.

Various types of combination cases and bags are also known which can be used for carrying both the clothing and equipment for racquet sports. The combined article includes a racquet case which is separate from, but secured permanently to, a bag-like section used for carrying clothing and other equipment related to that particular racquet sport. Articles of this type typically include a single, bag-like section into which clothing, shoes, towels, etc. are placed. U.S. Pat. No. 3,963,103, entitled COMBINED CARRYING BAG AND RACKET CARRIER, discloses a combined carrying case of this type.

As more and more people become involved in sports activities, and especially racquet-type sports, it has been found that a need arises for improving the types of carrying cases for transporting the paraphernalia associated with a specific sport. Moreover, as people travel for vacation or work purposes, they ofttimes include sports gear for use during recreation periods. It has been found necessary and desirable to be able to utilize a single carrying case for transporting the necessary paraphernalia both before and after the specific sports activity has been engaged in.

SUMMARY OF THE INVENTION

Accordingly, one object of the present invention is to provide an improved carrying case or bag for transporting sports equipment and associated gear.

Another object is to provide a carrying case or sport bag having a plurality of compartments, for containing a racquet, as well as wearing apparel and other paraphernalia required for playing a specific sport.

A further object is to provide a compartmented carrying case construction whereby different articles to be used for playing a sport, such as a racquet sport, can be maintained in a separated condition with respect to each other.

Other objects and advantages of this invention will become apparent from a consideration of the following specification and accompanying drawings.

BRIEF DESCRIPTION OF THE DRAWINGS

The invention will best be understood by reference to the following drawings, wherein.

DESCRIPTION OF THE PREFERRED EMBODIMENT

Figure 2:
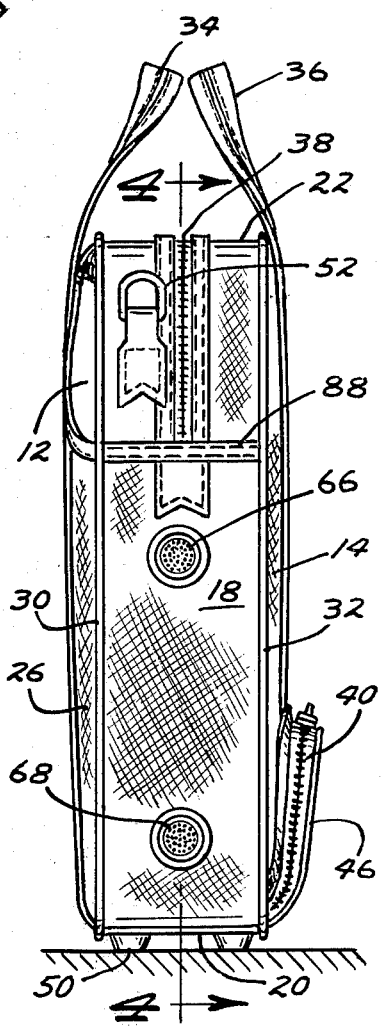
FIG. 2 is a side elevational view of the sport bag, but without the racquet.

The FIGURES illustrate a compartmented carrying case of sport bag designated generally by reference numeral 10. The bag includes a pair of opposed, spaced side panels 12 and 14, a pair of end walls 16 and 18, a bottom wall 20 and a top wall 22. The end walls 16 and 18, the bottom wall 20 and the top wall 22 define a peripheral wall or gusset designated generally by numeral 24. It might be pointed out that the top wall 22 extends downwardly a short distance so that it meets the end walls 16 and 18 at a junction shown by bindings 88 (see FIG. 2). It might also be noted that the corners of the bag are gently rounded or curved.

A third side panel 26 is provided, which overlays the side panel 12 and it forms a compartment for carrying a racquet 28. A welting 30 defines the periphery of the side panel 12, and at least a portion of the panel 26, and a welting 32 defines the periphery of the side panel 14. While not essential to the construction of the bag 10, the construction preferably includes a small, elongated coil spring 35 within the weltings 30 and 32. The coil spring 35 extends the entire length of the welting, and it assists in giving the bag structure its desired shape, as well as increased strength.

The specific manner in which the various panels and walls are secured together will be described below. A pair of carrying straps 34 and 36 are provided for conveniently carrying the bag. The strap 34 is secured to the panel 26 by appropriate means, such as stitching, so that it extends to the bottom wall 20 of the bag. The strap 36 is secured to the panel 14 so that it extends partially toward the bottom wall 20. The straps 34 and 36 help distribute the weight of the bag and its contents along the side panels. A pair of rivets 37 are provided proximate the upper portion of the bag, for reinforcement purposes. For example, if the bag 10 is grasped by only a single strap 34 or 36, such strap will not pull away from its respective panel.

At this point, it might be mentioned that the bag may be constructed of a variety of materials, such as a suitable grade of woven or vinyl fabric or plastic material of a light, flexible nature. Furthermore, while the panels and walls are shown as being of a single wall construction, it might be preferred to make the bag from double layers of material, i.e., an inner lining layer, and an outer decorative layer of somewhat more durable and wear resistant material. If might also be considered desirable to include a middle stiffening layer between the two layers of material, as disclosed, for example in my U.S.

Pat. No. 3,730,308 entitled LUGGAGE CONSTRUCTION.

A pair of openings are provided for introducing articles into, and removing articles from, the bag 10. The top wall 22 is provided with an opening which extends completely across the top wall 22, and as depicted for example, in FIGS. 2 and 5, down toward the end walls 16 and 18, so as to provide easy access into the bag. Closure means in the form of a zipper 38 with a pair of zipper slides 41 and 42, is provided for opening and closing the bag.

Figure 3:
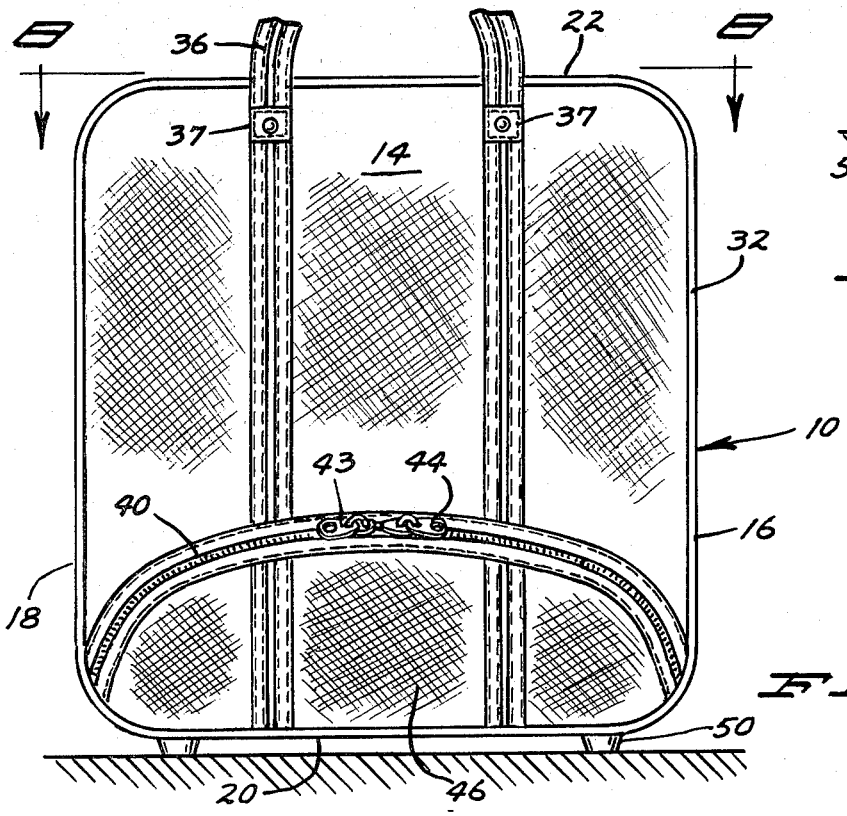
FIG. 3 is a rear elevational view of the sport bag illustrated in FIG. 1.
Figure 4:
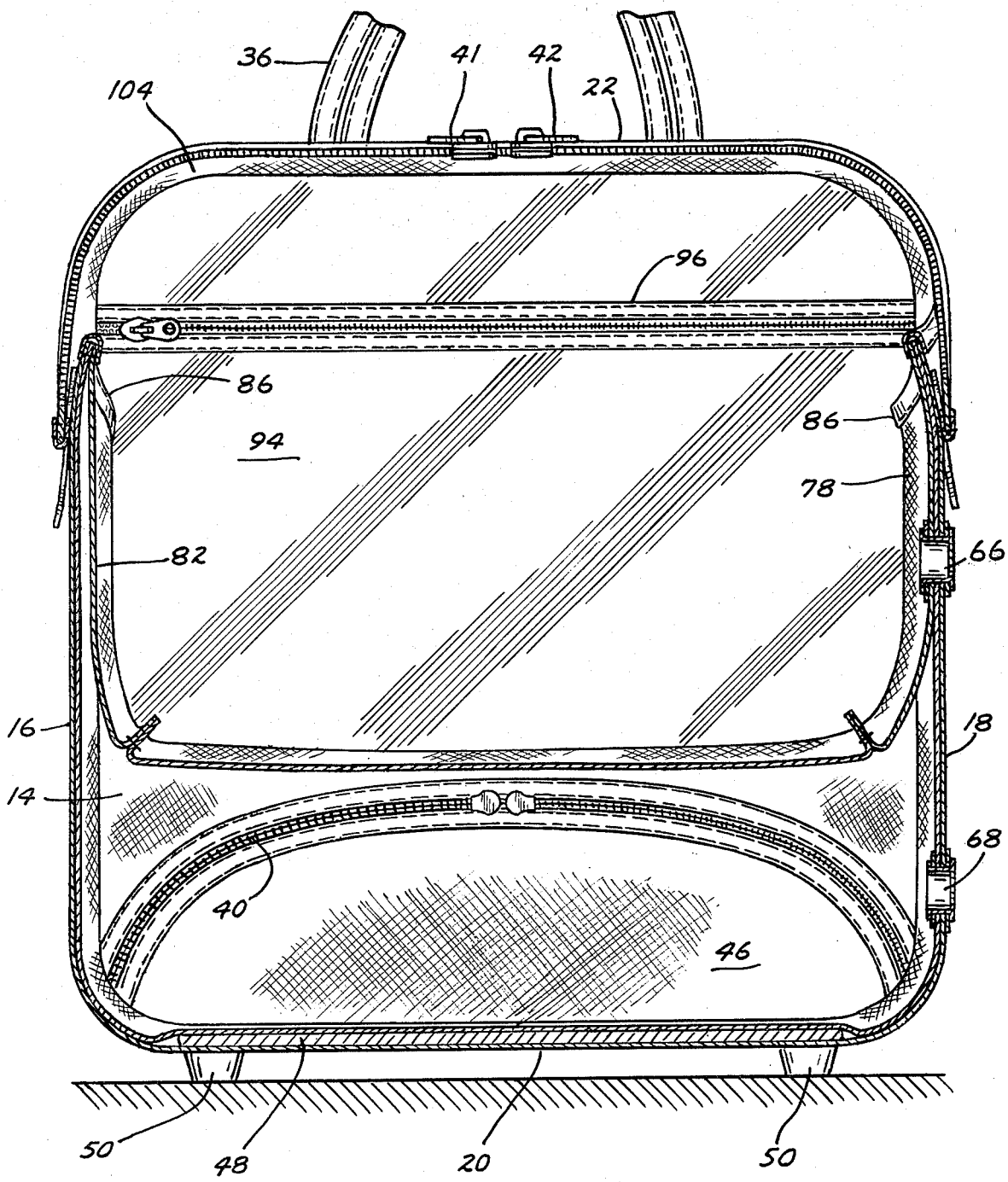
FIG. 4 is a cross-sectional view taken along line 4—4 of FIG. 2.

A second opening is provided in the side panel 14 proximate its lower portion, as shown more fully in FIG. 3. As illustrated, a curved zipper track 40 extends from a point adjacent the lower left hand corner of the bag 10 (as shown in FIG. 3) in an upward direction toward the center of the bag and then downward toward the lower right hand corner of the bag. A pair of zipper slides 43 and 44 are included for opening and closing the curved opening. If desired, an appropriate lock (not shown) can be provided for securing the zippers in a closed position. The zipper 40 defines a flap 46 which swings or pivots in a downward direction when the zipper is opened. This permits convenient access to the lower portion of the bag 10.

A bottom support plate 48 is provided within the bag along the bottom wall 20 for reinforcing the bag, and it is covered with a lining material. The plate 48 prevents the bottom of the bag from sagging when the bag is lifted. A pair of air vents 66 and 68, are provided in the end wall 18, for permitting air to circulate within the bag 10. A plurality of legs 50 are secured to the bottom wall 20 and support plate 48 by rivets, or the like. A pair of attachment rings 52 are attached to the upper portion of the end walls 16 and 18 for attaching a shoulder strap 54 to the bag; such shoulder strap 54 being readily removable from the bag by appropriate snaps 56.

Figure 1:
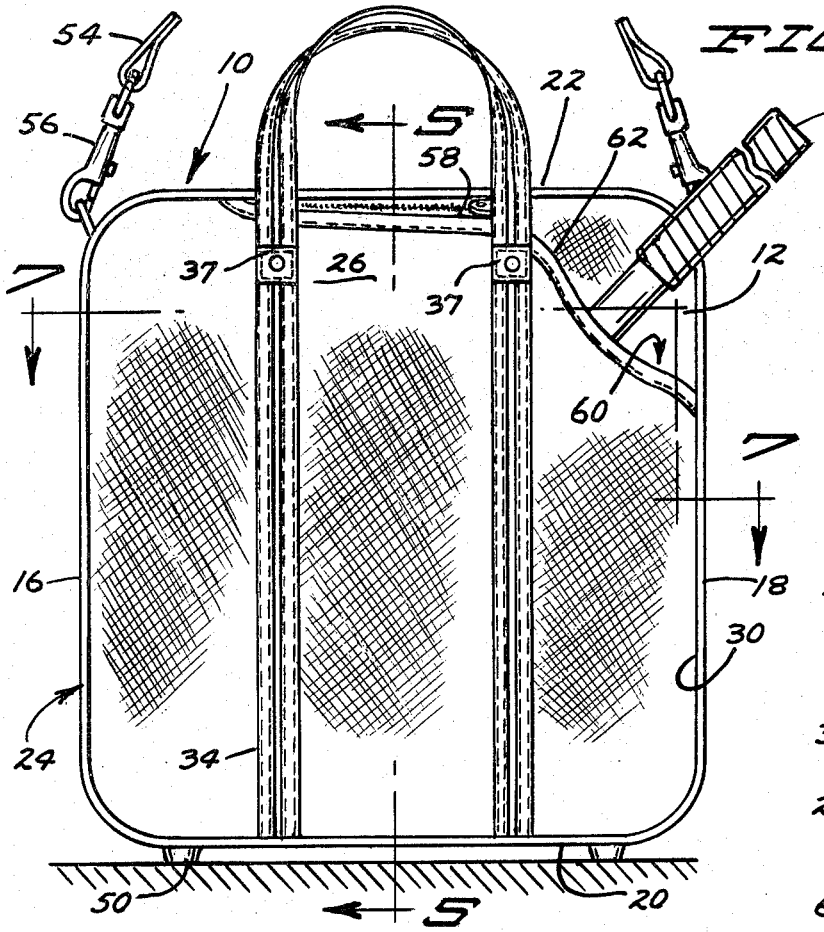
FIG. 1 is a front elevational view of a carrying case or sports bag constructed in accordance with the present invention, such figure including a racquet which is held in a side compartment.
Figure 8:
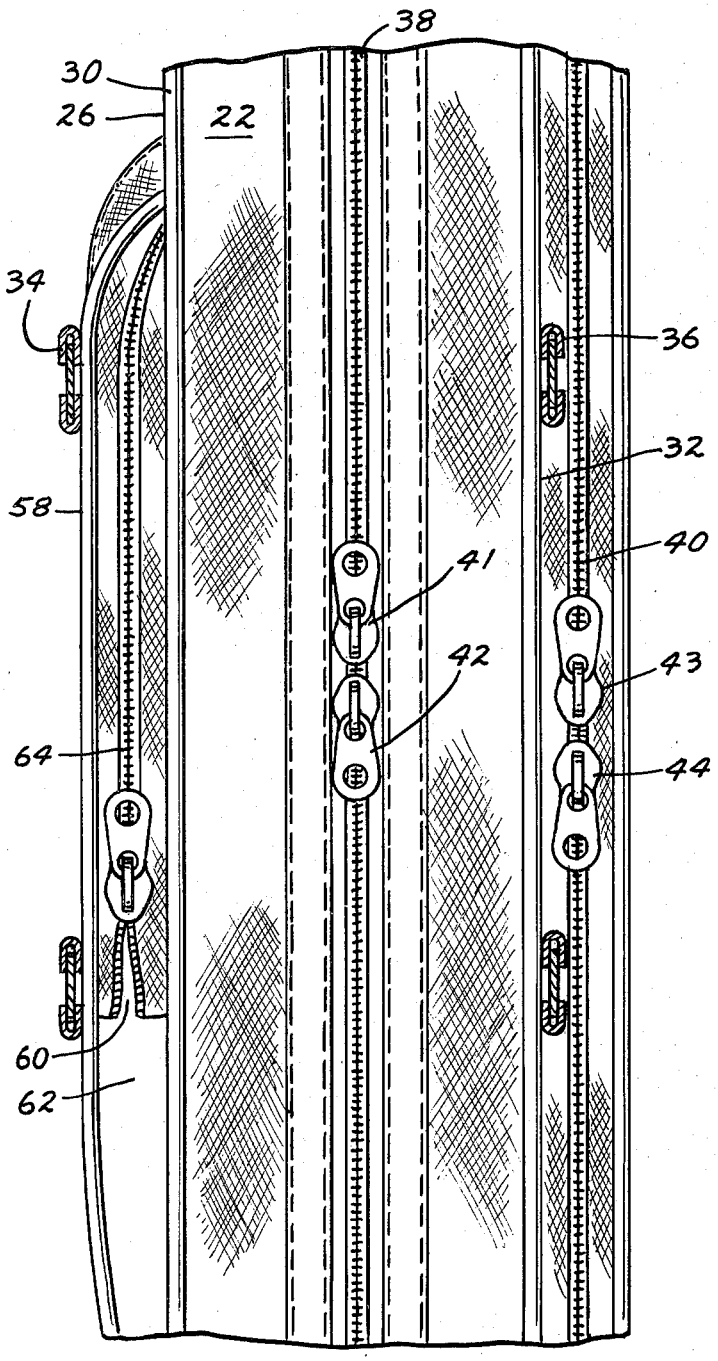
FIG. 8 is an enlarged partial top view of the sport bag, taken along line 8—8 of FIG. 3.
Figure 9:
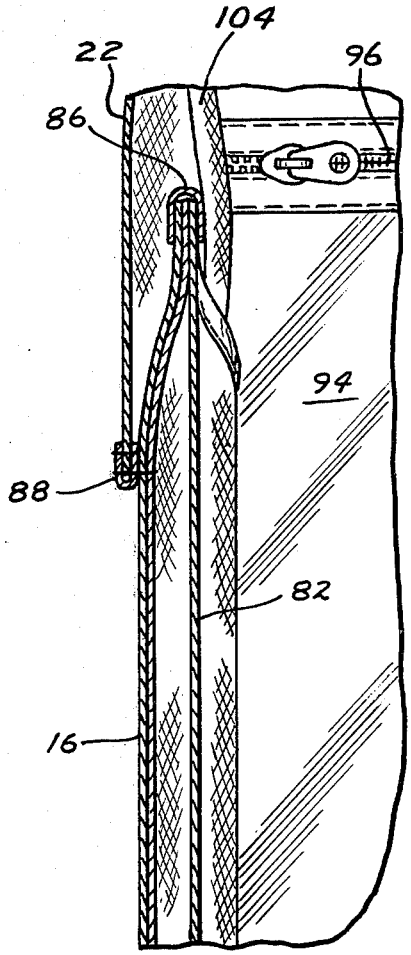
FIG. 9 is an enlarged partial cross-sectional view taken along line 9—9 of FIG. 7.

The side panel 26 is attached to the bag 10, and more specifically the side panel 12 so that it forms a compartment designated by numeral 60, such compartment adapted to accommodate the racquet 28. As shown in FIGS. 1 and 8, the panel 26 has substantially the same rectangular configuration as the side panel 12, and it is secured to the panel 12 by the welting 30 along the end wall 16, the bottom wall 20, the end wall 18, and a small portion of the top wall 22. An opening 62 is provided along the top edge of the panel 26 so that the racquet 28 can be inserted into the compartment 60. A binding 58 is provided along the top edge of the panel 26. I have found that it is advisable to provide a zipper 64 for closing at least a portion of the opening 62. By closing the zipper 64 after the racquet has been inserted into the compartment, the racquet is effectively prevented from inadvertently being removed from the compartment. Moreover, as shown in FIG. 1, the racquet handle projects from the compartment 60 at an angle, this makes it easier to carry the bag.

Figure 5:
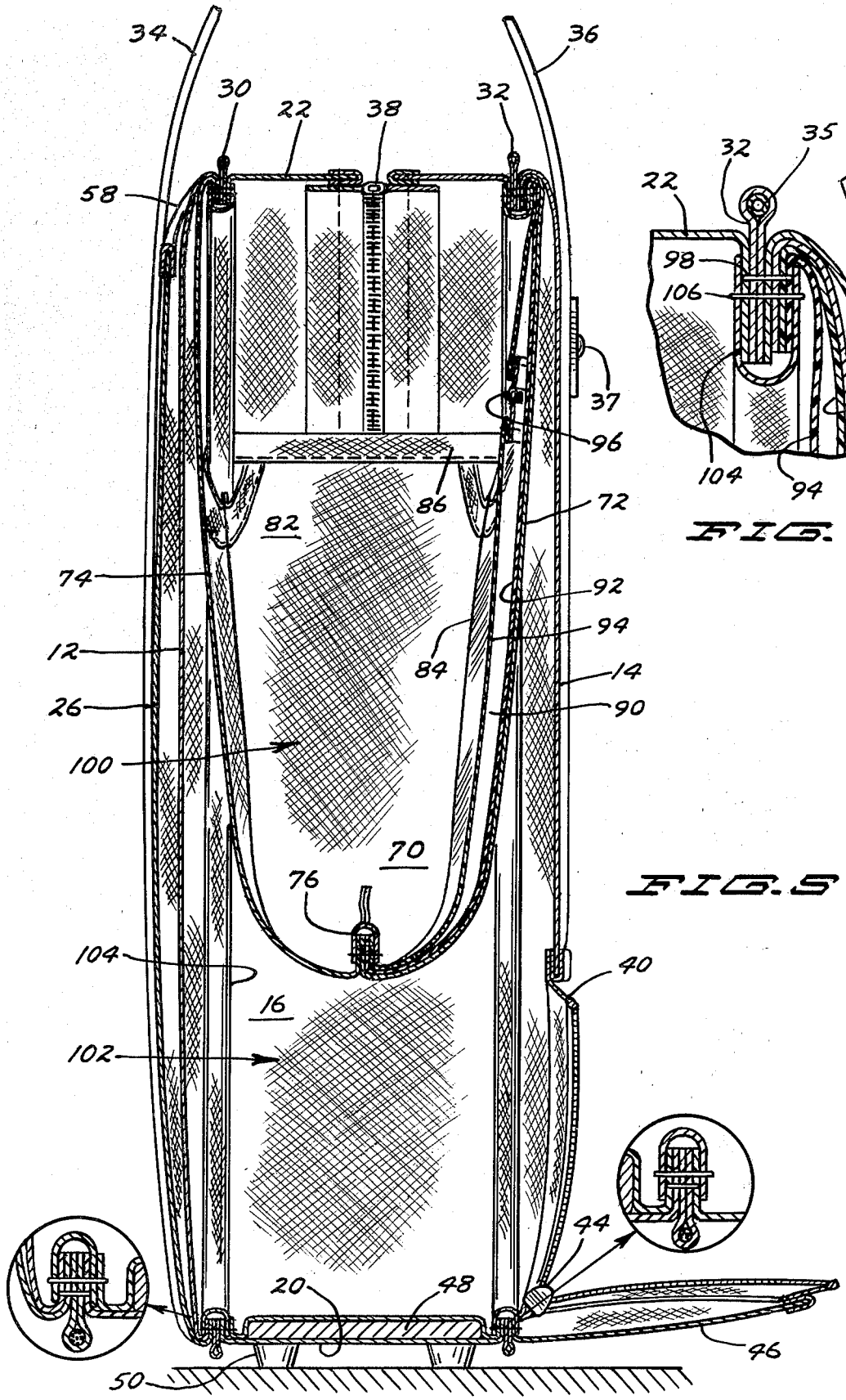
FIG. 5 is a cross-sectional view taken along line 5—5 of FIG. 1, but without the racquet.

Reference is now made to FIGS. 4–7 and 9, which illustrate the internal construction of the bag 10. As illustrated in FIG. 5, an elongated hanging compartment or sack 70 is suspended within the bag 10 by attaching it along its top edge to the top of the bag 10. The hanging compartment 70 is preferably formed of a flexible cloth material, and as viewed in FIG. 7, it extends longitudinally from the wall 16 to the wall 18 of the bag 10, and it forms a first clothing compartment 100 within the bag 10. A second clothing compartment 102 is formed below the hanging compartment 70.

The compartment 70 is formed from a first side panel 72 and a second side panel 74, such panels being joined together at their bottom by a binding 76 and stitching which extends through the binding 76. A first end panel 78 is joined to the end of the panels 72 and 74 proximate the end wall 18 by stitched seams 80, and a second end panel 82 is joined to the opposite ends of the panels 72 and 74 by stitched seams 84 to complete the hanging compartment 70. The top of the end panel 82 is provided with a binding 86 which joins the top of the panel 82 to the end wall 16 and the top wall 22, as depicted more fully in FIG. 9. A binding 88 is stitched over the edge of the top wall 22, and it is then stitched to the end wall 16.

The end panel 78 is attached to the end wall 18 and the top wall 22 in a similar manner. It should be noted, however, that the air vent 66 secures the end panel 78 to the end wall 18; the vent 66 permits air to flow into the hanging compartment 70. The vent 68, on the other hand, permits air to flow into the lower compartment 102.

A rectangular-shaped pouch 90 is also provided within the hanging compartment 70, it is positioned adjacent to the first panel 72, and it also extends longitudinally within the bag 10 from the end wall 16 to the end wall 18. The pouch 90 is preferably formed of a substantially moisture-proof material, such as a transparent vinyl. As shown in FIG. 5, the pouch is formed by a first panel 92 which is positioned proximate the first panel 72 of the hanging compartment, and a second panel 94 which is spaced from the first panel 92 to form a space or pouch therebetween. The upper and lower edges of the panels 92 and 94 are stitched to the upper and lower edges of the panel 72. A zipper 96 is provided for opening and closing a longitudinal slit formed in the panel 94.

Figure 6:
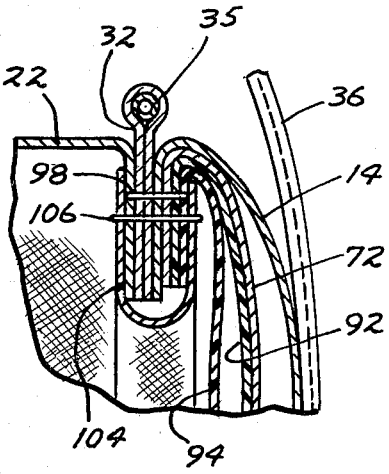
FIG. 6 is an enlarged partial cross-sectional view which illustrates the upper right hand portion of the sport bag shown in FIG. 5.
Figure 7:
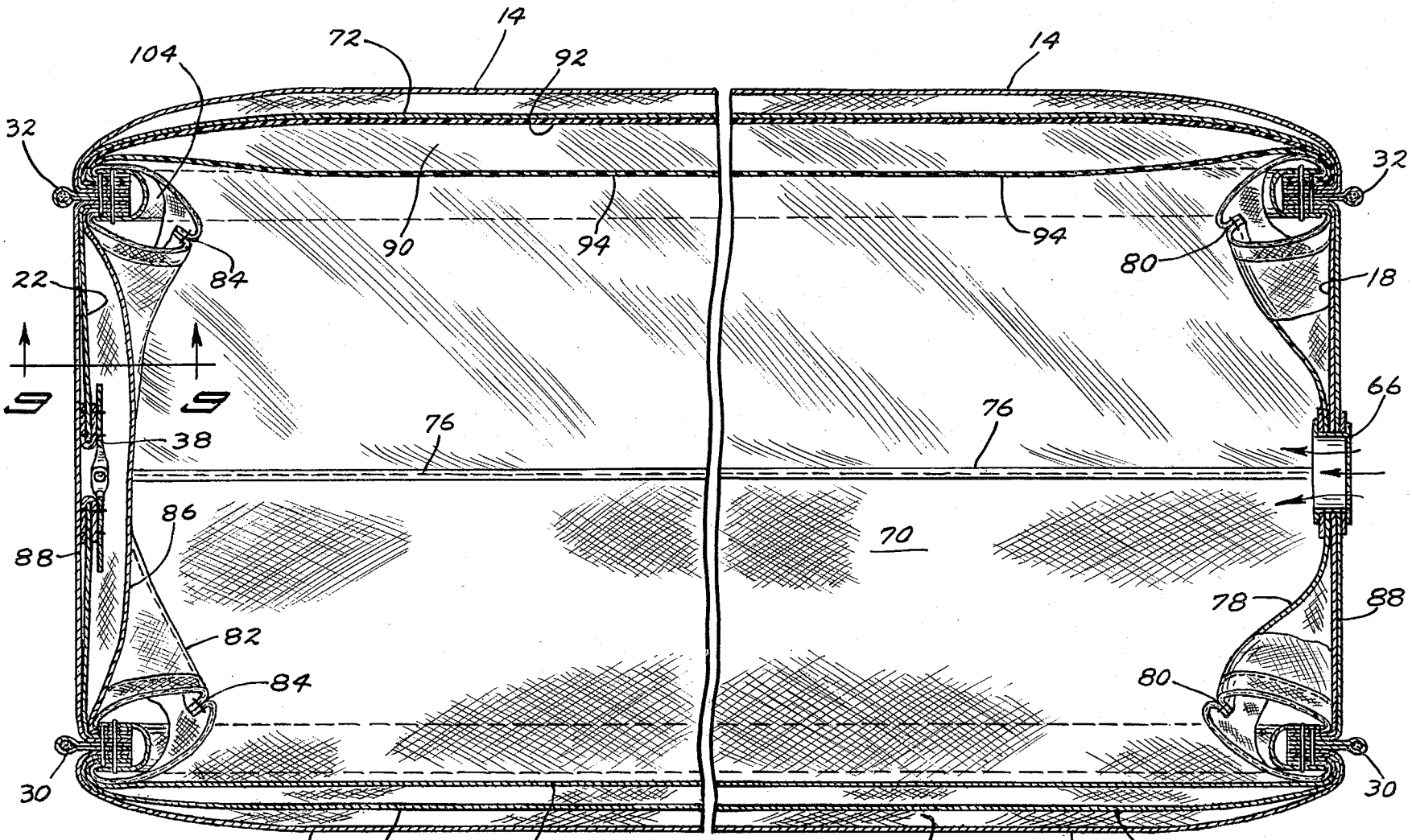
FIG. 7 is an enlarged cross-sectional view taken along line 7—7 of FIG. 1.

Reference is now made to FIG. 6 which is an enlarged view of the upper right hand corner of FIG. 5. FIG. 6 illustrates the manner in which the various panels are joined together, and it is representative of the construction used in assembling the bag 10. It should be observed that the top wall 22, the side panel 14, the first panel 72 of the hanging compartment 70, and the panels 92 and 94 of the pouch are joined together by stitching 98. Thereafter, a binding 104 is sewn to the juncture by stitching 106. It should be realized, of course, that while the side panels 12 and 26 are joined to the top wall 22 and the hanging compartment in the same general manner, the specific construction varies somewhat since there is no pouch on that side of the bag 10. The general principle is the same, however.

In use, it is contemplated that a pair of athletic shoes will be placed in the lower clothing compartment 102 by opening the zipper 40 and the flap 46. Other wearing apparel, towels, etc., are placed in the hanging compartment 70 (i.e., first clothing compartment 100) by opening the zipper 38. If some of the clothing is wet, eg., a swimming suit, it can be placed in the pouch 90 so that it is kept separate from the other articles in the bag. Since the hanging compartment 70 is suspended from the top of the bag 10, it should be recognized that it can easily be pushed upwardly to accommodate the placement of more articles in the lower compartment 102. This is a distinct advantage because it enables the bag user to virtually fill the bag from the bottom, if desired. Moreover, it should be recognized that although the sport bag has been described in conjunction with the use of sports equipment, such as a racquet, the sport bag can also be used for a variety of other purposes, as well, such as an over-night bag, because it provides multiple compartments for carrying wearing apparel.

Now, therefore, I claim:

1. A compartmented sport bag for a racquet and associated wearing apparel comprising a case formed by a pair of opposed side panels, a pair of opposed end walls, a bottom wall, and a top wall, said end, bottom and top walls forming a gusset which surrounds the sport bag, said bag having an inner surface, said top wall being provided with a first opening, closure means for closing said first opening, one of said side panels being provided with a second opening proximate the bottom wall, closure means for closing said second opening, an elongated, flexible hanging compartment within the sport bag which forms a first compartment therin, said hanging compartment having a top edge and being substantially the same length as the length of the sport bag, said compartment including a pair of elongated side panels and a pair of opposed end panels, means for joining the bottom edges of said side panels together, means for joining said end panels to the ends of the side panels, and means for securing the top ends of said side panels to the top wall of the sport bag whereby said hanging compartment is suspended within the sport bag, the top edges of said end panels remaining unattached to the top wall of the bag, the bottom of said hanging compartment being spaced a predetermined distance from the bottom wall of the sport bag whereby a second compartment is formed within the sport bag, said first opening permitting articles to be placed in said first or hanging compartment and said second opening permitting articles to be placed in said second compartment.

2. The combination of claim 1 wherein a third compartment is provided for holding a racquet, said third compartment located exteriorly of the bag, said third compartment being formed by a third side panel having substantially the same configuration as the pair of side panels, means for attaching said third panel to the bag so that it is proximate the side panel without the second opening therein, said means securing said third panel along its edges to the bag thereby forming a racquet compartment, said compartment being provided with an opening along its top edge so that a racquet is insertable within said compartment, and means for closing at least a portion of said opening.

3. The combination of claim 1 wherein the top wall of the bag has a pair of side edges and each side panel has a top edge, a seam is formed by the juncture of the side edges of the top wall and the top edge of the side panels, the top edge of the side panels of said hanging compartment being joined to the top wall of said bag at said juncture by the securing means.

4. The combination of claim 3 wherein the sport bag has a pair of top corners which are rounded, the top wall having a pair of end portions which extend downwardly to a point below the top surface of the sport bag, each end wall having an upper end, means for attaching the ends of said top wall to the upper ends of the end walls of the bag at a juncture spaced below said top surface, and the first opening extends from a first juncture formed by a side wall and said top wall across the top of the bag to a second juncture fromed by said top wall and the second side wall.

5. The combination of claim 2 wherein the side panels of the compartment have a rectangular shape, a rectangular-shaped pouch is provided with the hanging compartment, said pouch having substantially the same shape and size as the panels of the hanging compartment, said pouch being formed of first and second spaced-apart panels, a first panel being positioned adjacent to one of the side panels of the hanging compartment, means for securing the top edge of each pouch panel to the top wall of the sport bag, and means for securing the bottom edges of the pouch panels together, said pouch being formed with an elongaged slit in the second panel.

6. The combination of claim 5 wherein the pouch is formed of a substantially moisture-proof material, and closure means are provided for closing said slit.

7. The combination of claim 2 wherein a flap is formed by the second opening in the sport bag, said opening having a curved configuration which extends along the length of the sport bag, so that said flap can be pivoted to an open position thereby forming an opening into the lower portion of the sport bag.

8. The combination of claim 1 wherein a pair of air vents are provided in one of the end walls, a first vent permitting air to flow into the first or hanging compartment and a second vent permitting air to flow into the second compartment.

9. The combination of claim 2 wherein first and second carrying straps are provided, means for attaching a first carrying strap to the exterior surface of the third side panel so that it extends to the bottom wall, and means for attaching a second carrying strap to the exterior surface of the side panel having the second opening therein, said second carrying strap extending to said second opening.

10. The combination of claim 9 wherein rivet means are provided proximate the upper portion of the straps and the panels, for reinforcing the attachment of each strap to its respective panel.

* * * * *